United States Patent [19]

McQueen

[11] 4,435,868

[45] Mar. 13, 1984

[54] HIKER'S HATCHET

[76] Inventor: Sidney J. McQueen, 414 Coors Blvd. SW., Albuquerque, N. Mex. 87105

[21] Appl. No.: 365,035

[22] Filed: Apr. 2, 1982

Related U.S. Application Data

[63] Continuation-in-part of Ser. No. 189,579, Sep. 23, 1980, abandoned.

[51] Int. Cl.[3] ..... B26B 11/00

[52] U.S. Cl. ..... 7/158; 30/151

[58] Field of Search ..... 7/106, 145, 158, 167; 30/151; 145/2 R, 62; 224/234

[56] References Cited

U.S. PATENT DOCUMENTS

| | | | |
|---|---|---|---|
| 1,176,192 | 3/1916 | Beckton et al. | 145/62 |
| 2,559,689 | 7/1951 | Truesdell | 30/151 |
| 2,721,340 | 10/1955 | Shultz | 7/145 |
| 2,948,960 | 8/1960 | Eckstein | 7/158 X |
| 3,321,783 | 5/1967 | Ivan | 7/145 |
| 3,473,712 | 10/1969 | Genchi | 7/145 X |
| 3,581,323 | 6/1971 | Hayes | 7/158 X |
| 3,627,007 | 12/1971 | Rieffer | 7/145 X |
| 3,842,458 | 10/1974 | Baur | 7/158 X |

*Primary Examiner*—James G. Smith
*Attorney, Agent, or Firm*—Walter R. Keller

[57] ABSTRACT

A hiker's hatchet with a knife sheathed in the handle of the hatchet whereby the grip of the knife also forms the grip of the hatchet, but when belt carried the knife may be removed without removing the hatchet from the belt, and when used as a fish knife the knife protrudes beyond the hatchet head, thereby in one unit providing a skinning and cleaning knife and a beheading hatchet.

2 Claims, 3 Drawing Figures

HIKER'S HATCHET

This is a continuation in part of application Ser. No. 189,579 filed Sept. 23, 1980, now abandoned.

BACKGROUND

1. Field of the Invention

This invention pertains generally to the field of multiples use implements or combination tools, and more particularly to hatchets or small axes and knives.

2. Description of Prior Art

TRUESDELL, U.S. Pat. No. 2,559,689 disclosed a sheathed knife in which the hand grip slides up and down the hatchet handle, and when the hand grip is slid toward the hatchet head the hatchet handle, shaped to a knife blade was exposed. The tool has to be used as a unit, i.e. the knife and hatchet cannot be separated.

SUMMARY

It is an object of this invention to provide a hatchet knife tool which can be used together as a hatchet or knife, or may be used separated or assembled with the hatchet feature; and it is further an object of the invention to provide such a tool in a light weight configuration with a quick release carrying sheath.

DESCRIPTION OF THE PREFERRED EMBODIMENT

Figure 1:
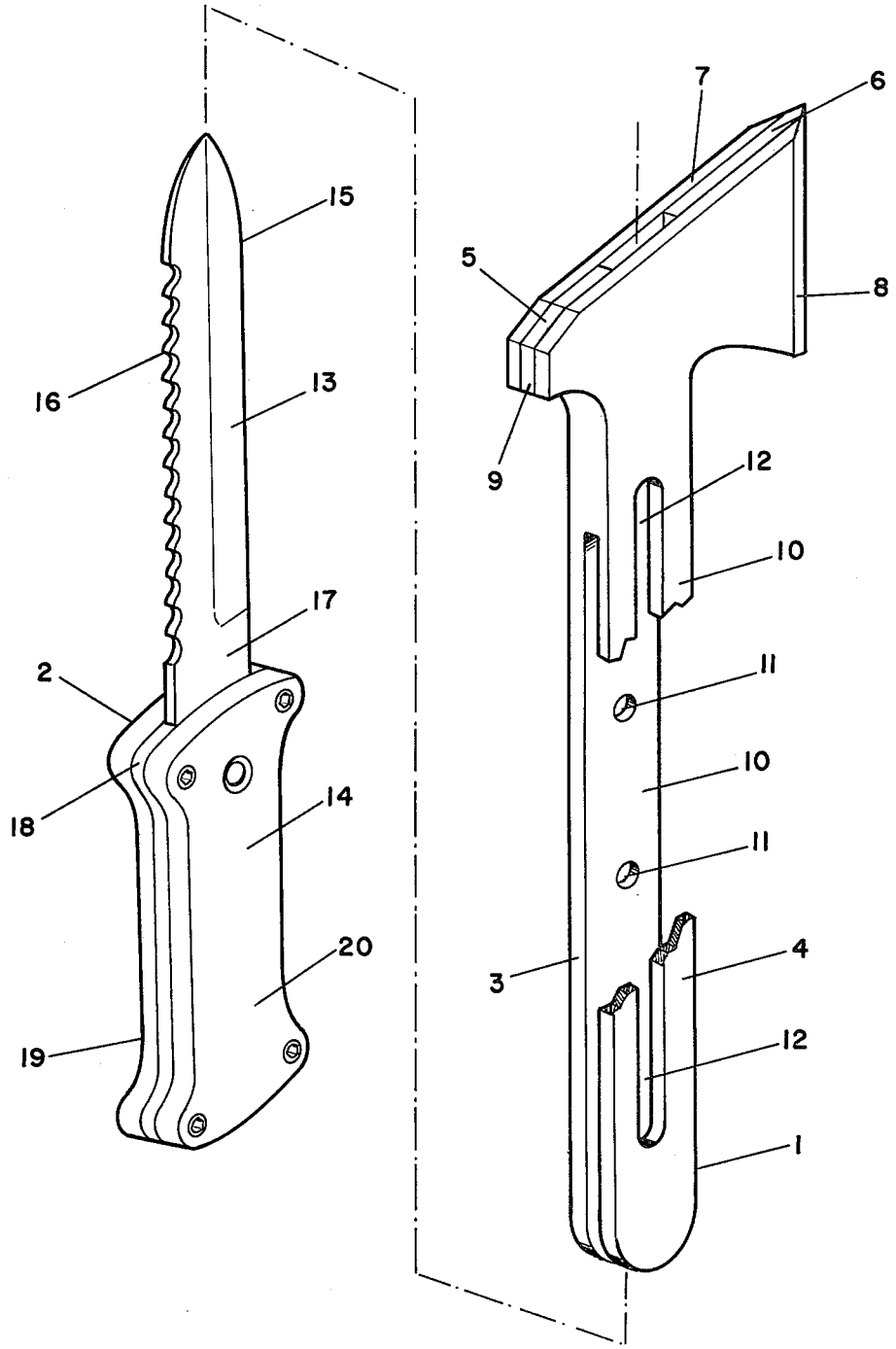
FIG. 1 is an isometric view of the invention.
Figure 2:
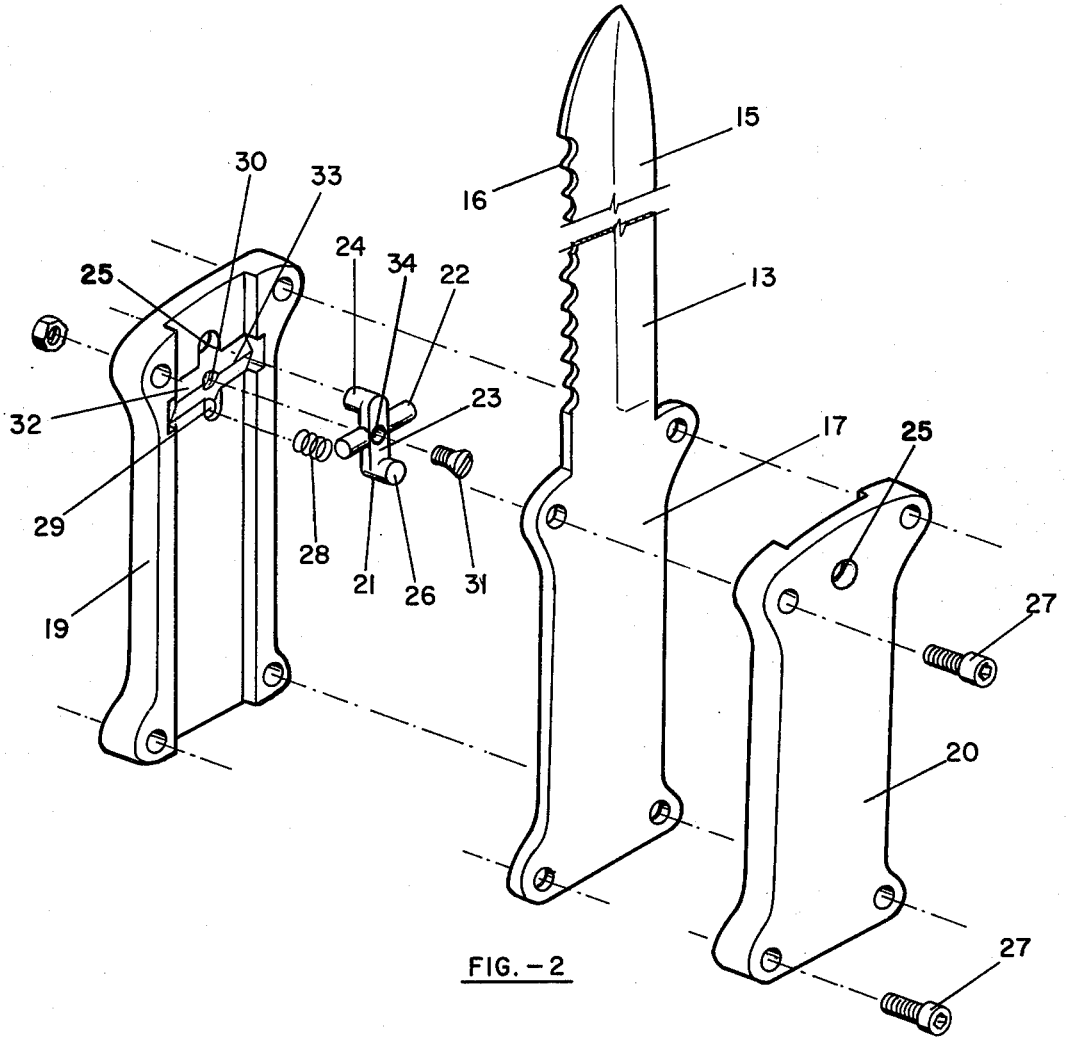
FIG. 2 is an isometric exploded view of the knife.

FIG. 1, shows the invention to have a hatchet 1 and knife 2. The hatchet 1 consists of left hand side 3 right hand side 4 and hammer spacer 5 and edge spacer 6. The left hand side 3 and the right hand side 4 are initially shaped identical in blank form having a typical hatchet head portion 7 which ha the hatchet blade 8 and hammer end 9, and a straight handle 10 rounded at its extremity, all integrally formed. The left hand side 3 and right hand side 4 are flat plate members. The general shape of the hammer end 9 can vary, but as depicted is trapezoidal. The hammer spacer 5 is also flat plate shaped to the contour of the hammer end 9; however, the dimension of the hammer spacer 5 from the hammer end 9 toward the hatched blade 8 is only such that it stops at an extension of the nearest line defining the edge of the handle 10. The edge spacer 6 is likewise a flat plate member shaped to th shape of the hatchet blade 8 portion of the hatchet head 7. The dimension of the edge spacer 6 from the hatchet blade 8 toward the hammer end 9 is only such that the edge spacer 6 ends on an extension of the nearest line defining the edge of the handle 10. The left hand side 3 has a plurality of stop holes 11 drilled through the handle 10 along the centerline of the handle 10. The right hand side 4 has a longitudinal slot 12 through its handle 10 said slot 12 running from the vicinity of the hatchet head 7 to near but not all the way toward the rounded end of the handle 10. The left hand side 3, hammer spacer 9, and edge spacer 6 and right hand side 4 are then assembled as by welding to form the hatchet 1, whose blade is then sharpened. The hammer end 9 may be tapped to permit other attachments. Thus assembled, there is a space between the two sides of the handle 3 and 4, and said space continues through the hatchet head 7.

The knife 2 consists of the blade 13 and handle 14. The blade 13 is a flat member whose thickness is the same as the edge spacer 6 and hammer spacer 5. One edge of the blade 13 is honed to a knife edge 15 while the other edge of the blade is cut and sharpened to a saw tooth 16 edge. Both the saw tooth edge 16 and knife edge 15 extend from the blade point approximately half the length of the blade 13, and the remainder of the blade 13 becomes the shank 17 on to which the handle 14 is attached. Near the knife edge 15 and saw tooth edge 16 the shank has two ears 18 one on each edge; and near the end of the shank handle end of the blade 13 the blade has two more ears one on each edge. The ears 18 are flat extensions of the blade, generally semicircular in shape with a hole therein. The handle 14 consists of two halves, a left hand half 19 and a right hand half 20. The handle 14 is generally shaped on the outside to a comfortable grip shape, each half 19 and 20 having ears near the blade edge 15 and saw tooth edge 16 and again near the handle end of the blade 13. The left hand end 19 and right hand side 20 have flat inner faces, each inner face having cut therein a wide flat groove the width of the hatchet handle 10 and a depth equal to slightly more than the thickness of the left hand side 3 of the hatchet handle plus the thickness of the knife blade 13. The left hand half 19 of the handle 14 has a button hole 25 drilled from its exterior to the groove on its inside. The left hand half 19 of the handle 14 has in addition a small circular depression 29 partially but not all the way through the left hand half 19, said depression 29 to accommodate a spring 28. The depression 29 is located axially aligned in the left hand half 19 with the button hole 25, yet deplaced along the left half 19 a small distance away from the blade 13. The left half 19 further has a screw hole 30 to accept pivot screw 31, said screw hole 30 being axially aligned and approximately midway between the button hole 25 and the depression 29. The left hand half 19 in the general area of the button hole 25, screw hole 30, and depression 29 in the flat wide groove has a cross shaped recess 32. Said cross shaped recess 32 extends longitudinally to include the button hole 25 and to include the spring recess 29; and the cross-shaped recess 32 extends transversely across the flat wide groove and only slightly beyond the width of the flat wide groove, transversly aligned with the screw hole 30. The cross-shaped recess 32 is deeper from the bottom of the bottom of the flat wide groove in the vicinity of the button hole 25 and the depression 29 than in the vicinity of the screw hole 30. The bottom of the cross shaped recess 32 slopes from the button hole 25 to the screw hole 30 and from the depression 29 to the screw hole 30, thus forming a pivot crown 33 transversly across the cross shaped recess 32 at the location of the screw hole 30. Affixed to the inside of the flat wide groove is a pivot latch 21 which has two pivots 22 protruding edgewise from its mid-point which pivot points are rotatable installed in the sides of the groove in the left half 19, over the pivot crown 31. The pivot latch 21 has flat long body 23 on one end of which is a button 24 which protrudes through the button hole 25, and on other end a lock stud 26 which protrudes toward the handle of the knife blade 13. The lock stud 26 is sized to fit slideably and easily into the stop holes 11, and is biased to engage the stop holes 11 by the spring 28 installed in the left half 19 in the depression 29. The pivot latch 21 has a longitudinal oblong attaching hole 34 through which the pivot screw 31 slideably passes; said pivot screw 31 threadably engaging the screw hole 30; and pivotally securing the pivot latch 21 in the left hand half 19. The pivot screw 31 serves only to retain the pivot latch 21 in the half handle 19 at the proper location when the knife 2 is withdrawn from the hatchet 1. The pivot screw 31 must be screwed into screw hole 30 sufficiently to preclude interference with the straight handle 10 of the left hand side 3 or the right hand side 4 of the hatchet 1, but not so tight that the pivot latch 21 cannot pivot. A few thousandths of an inch clearance will provide sufficient clearance for the pivot latch 21 to pivot. If the pivot screw 31 is screwed in to the screw hole 30 so as to forcefully secure the pivot latch 21 to the half handle 19, repeated pressure on the pivot latch 21 will bend and break the pivot screw 31 or the half handle 19. Thus the pivot latch 21 is pivotally secured. The spring depression 29 and the spring 28 are illustrative only of any known biasing means. The right hand half 20 of the handle 14 is similarly shaped, grooved, with a similar button hole, screw hole, depression and recess, and installed therein in another pivot latch 21, and spring 29, not shown. However, the button 24 is shortened slightly so that it barely protrudes through the button hole 25 on the right half 20 of the handle 14. The pivot latch 21 on the right hand half 20 of the handle 14 is sized to fit into the longitudinal slot 12 in the right hand side 4 of the hatchet 1 handle 10. The left half 19 and right half 20 of the handle 14 is then assembled to the blade 13 by bolts 27 which pass through both halves of the handle 14 of the ears 18 of the blade 13. The knife 2 assembly is now complete. The knife 2 may be slid on to the hatchet 1 by inserting the blade 13 between the left hand side 3 and the right hand side 4 of the hatchet handle 10. As the knife 2 is slid towards the hatchet head 7, the left hand side 3 and the right hand side 4 will pass through the wide flat grooves on the inner sides of the handle 14 as the blade 13 passes through the space in the hatchet head 7. The lock stud 26 on the left half 19 engages individually one of the stop holes 11 securing the position of the handle 14 with respect to the hatchet 1. The lock stud in the right half 20 of the handle 14 engages the longitudinal slot 12 in the right hand side 4 of the handle 10 of the hatchet 1. Because, the button 24 protruding through the right half 20 of the handle 14 has been shortened, it must be deliberately pressed to disengage the lock stud; this provides safety in that the knife 2 cannot be inadvertantly released while the invention is being used assembled as a hatchet 1.

Figure 3:
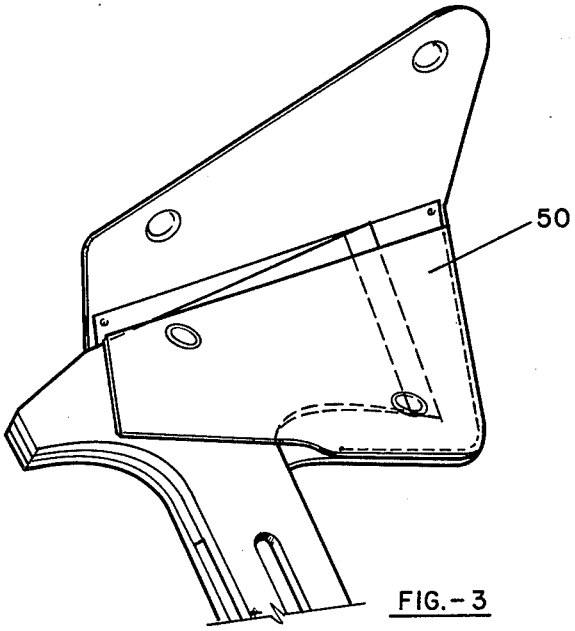
FIG. 3 is an isometric view of the hatchet head and carrying case.

FIG. 3 shows a belt carrying case 50, usually made of leather having a shape which securely attaches to the head of the hatchet 1 and can be attached to the belt of the wearer, and having two snaps which secure the hatchet therein by enclosing the hatchet head 7 so that it can not be removed. The inside of the top edge of the carrying case has a steel plate to prevent the knife 2 from inadvertantly being forced upward through the hatchet head 7 and the case 50. Thus attached 1 with knife 2 installed therein. The knife 2 may be removed from the hatchet 1 without the hatchet 1 being removed from the case 50.

I claim:

1. A combination tool comprising: a hatchet having a left side, a right side, a hammer spacer and an edge spacer, wherein the left side and the right side, each are flat plates shaped to a hatchet head and having integrally formed therewith a hatchet handle, being straight, the extremity of each of the hatchet handles being rounded: and wherein the hatchet head has a blade and a hammer end: and wherein the hammer spacer is a flat plate shaped to the contour of the hammer end, but extends from the hammer end toward the blade edge only to an extension of the line defining the nearest edge of the handle; and wherein the edge spacer is shaped to the contour of the blade but extends from the blade toward the hammer and only to an extension of the line defining the nearest edge of the handle; and wherein the left side handle has a plurality of stop holes along its length; and wherein the right side hndle has a longitudinal slot running from the vicinity of the hatchet head toward the extremity of the handle; and wherein the edge spacer and hammer spacer are the same thickness; and wherein the hammer spacer and edge spacer are placed between the left hand side and right hand side during assembly and rigidly and permanently assembled as by welding; and a knife having a blade and handle; the blade being a flat member whose thickness is the same as the hammer spacer and edge spacer: one edge of the blade sharpened to a knife edge and the other edge of the blade sharpened to a saw tooth edge, both the saw tooth and knife edges extending approximately one-half the length of the blade, the remainder of the blade being the shank, wherein the shank has two ears one on each edge adjacent to the knife edge and saw tooth edge, and two ears adjacent end of the shank, each of the said ears having a hole therein; and wherein the handle consists of two half handles, a right half and a left half, and the handle shaped to a comfortable grip; and the half handles having ears near the blade edge and saw tooth edge and having ears near the end of the shank said ears on the handle mating with the ears on the shank; and each said half handle having a flat wide groove on its inner faces, and a button hole from the inner surface to the outer surface; and each said half handle having a spring depression longitudinally aligned with the button hole, and a screw hole axially aligned and between the button hole and screw hole, and a cross shaped recess in the vicinity of the button hole, screw hole, and spring depression, said cross shaped recess having a pivot crown tranverse to the half handle, and the right half handle having pivotally installed in the flat wide groove on its inner surface in the recess, a pivot latch; said pivot latch having an oblong attaching hole, a lock stud sized to fit easily into the stop holes, and a button which protrudes through the button hole, said pivot latch being pivotally installed by a screw which slideably passes through the oblong attaching hole and threadably engages the screw hole; said pivot latch being biased such that the lock stud engages the stop holes; and a biasing means installed in the right half handle between the lock stud and the spring depression; and the left half handle having pivotally installed in the flat wide groove on its inner surface in the recess another pivot latch; said pivot latch installed on the left half handle having an oblong attaching hole, a lock stud sized to fit easily into the longitudinal slot, and a button which protrudes slightly less than flush with the outside of the left half handle, said pivot latch installed in the left half handles by a screw which slideably passes through the oblong attaching hole and threadably engages the screw hole; and said pivot latch being biased such that the lock stud engages the longitudinal slot; and a brasing means installed in the left half handle between the lock stud and the spring depression; and wherein the two half handles are assembled to the shank, by bolts passing through the holes in the ears on the half handles and the shank, and a means for sheathing the combination tool for safety and carrying.

2. The invention of claim 1 wherein the sheathing means comprises a case made of leather, shaped so that the head of the hatchet is secured therein and the case having a means for attaching to the belt of the wearer, and the case having a steel plate on the inside of its top edge.

* * * * *